US007237710B1

(12) United States Patent
Ong

(10) Patent No.: US 7,237,710 B1
(45) Date of Patent: Jul. 3, 2007

(54) EXPANDING FILE WITH MULTISIZE POCKET DIVIDERS

(76) Inventor: Bon S. Ong, Box 4247, Torrance, CA (US) 90510

( * ) Notice: Subject to any disclaimer, the term of this patent is extended or adjusted under 35 U.S.C. 154(b) by 407 days.

(21) Appl. No.: 10/959,760

(22) Filed: Oct. 7, 2004

Related U.S. Application Data

(63) Continuation-in-part of application No. 10/210,983, filed on Aug. 5, 2002, now Pat. No. 6,905,064.

(51) Int. Cl.
*B65D 27/00* (2006.01)
*B65D 27/08* (2006.01)

(52) U.S. Cl. ..... 229/67.3; 229/72

(58) Field of Classification Search ..... 229/67.1–67.4, 229/72

See application file for complete search history.

(56) References Cited

U.S. PATENT DOCUMENTS

| | | | | | |
|---|---|---|---|---|---|
| 205,869 | A | * | 7/1878 | Keighton | 229/72 |
| 325,676 | A | | 9/1885 | Jenkins | |
| 836,633 | A | * | 11/1906 | Cooke, Jr. | 229/72 |
| 975,792 | A | | 11/1910 | Pitmann | |
| 1,455,419 | A | | 5/1923 | Ahlquist | |
| 2,333,798 | A | | 3/1943 | Kner | |
| 2,729,258 | A | | 1/1956 | Pentland et al. | |
| 2,756,515 | A | | 7/1956 | Hoffman | |
| 3,399,823 | A | | 9/1968 | Johnson | |
| 3,885,841 | A | * | 5/1975 | Stevens | 312/183 |
| 4,129,214 | A | | 12/1978 | Gendron | |
| 4,262,838 | A | | 4/1981 | Mackensie | |
| 4,274,577 | A | | 6/1981 | Walsh, Jr. | |
| 4,549,688 | A | | 10/1985 | Ozmon et al. | |
| 4,995,221 | A | * | 2/1991 | Stemmer, Jr. | 53/455 |
| 5,031,772 | A | | 7/1991 | Woodriff | |
| 5,050,792 | A | | 9/1991 | Segall | |
| 5,271,502 | A | | 12/1993 | Chang | |
| 5,275,438 | A | | 1/1994 | Struhl | |
| 5,288,144 | A | | 2/1994 | Guderyon | |
| 5,664,724 | A | | 9/1997 | Ho | |
| 5,873,513 | A | | 2/1999 | Ong | |
| 6,047,879 | A | | 4/2000 | Henrickson et al. | |
| 6,182,827 | B1 | * | 2/2001 | Su | 206/425 |
| 6,419,083 | B1 | * | 7/2002 | Huang | 206/308.1 |
| 6,607,122 | B1 | | 8/2003 | Ong | |
| 6,669,080 | B2 | | 12/2003 | Ong | |
| 6,796,428 | B1 | * | 9/2004 | Ong | 206/425 |
| 6,837,368 | B1 | * | 1/2005 | Chang | 206/232 |
| 6,905,064 | B1 | * | 6/2005 | Ong | 229/67.4 |

* cited by examiner

*Primary Examiner*—Jes F. Pascua
(74) *Attorney, Agent, or Firm*—Cislo & Thomas LLP

(57) ABSTRACT

File section dividers for an expandable filing case are formed with expansive partitions having pocket panels extending from their lower edges and folded up and secured to the partitions. The pocket panels are formed with at least one linear pocket delineation seal parallel to the opposing side edges of the pocket panels. The pocket delineation seal divides the panel into a plurality of pockets which will have different sizes, depending upon the placement of the pocket delineation seal or plurality of seals. Preferably, pocket apron flaps are provided at the upper edges of the pocket panels to facilitate insertion and removal of documents and other objects into the pockets of the file section dividers. The file section dividers find their greatest utility when employed in a collapsible, portable document storage device having side panels formed into pleated accordion folds. Side edge marginal strips at the lateral, outboard extremities of the file section divider partitions are secured to corresponding surfaces in each of the pleated folds of the side panels.

22 Claims, 16 Drawing Sheets

55
53
51
49
48
57
34
26
53
22
44
48
49
59
51
57
55
44
44
60
18
20
160
260
12
24
28
14

EXPANDING FILE WITH MULTISIZE POCKET DIVIDERS

The present application is a continuation in part of U.S. application Ser. No. 10/210,983, filed Aug. 5, 2002, now U.S. Pat. No. 6,905,064.

BACKGROUND OF THE INVENTION

1. Field of the Invention

The present invention relates to improved file section dividers for office filing products which are configured to define pockets of different sizes and which have particular utility in portable, expandable filing cases.

2. Description of the Prior Art

In conventional office filing products an expandable office file is often divided from front to back into separate sections or compartments by a plurality of laterally extending file section dividers. Conventional file section dividers are typically formed as generally rectangular, expansive sheets of stiff but somewhat flexible material. These sheets extend from one side of the file enclosure to the other and are generally equipped with labeling tabs that project upwardly from the normally horizontal upper edge of the divider. Labeling indicia are placed on or inserted into these labeling tabs so as to identify the contents of the compartment in front of or behind the particular file section divider bearing the labeling tab. File section dividers such as these have been used for many, many years and are standard articles of office supplies.

Conventional file section dividers are somewhat deficient in that they are designed to accommodate only papers of a uniform, standard size within the filing compartments or sections to which they relate. For example, many file section dividers are constructed in a size suitable for storing within their confining compartments papers that are eight and a half inches in width and eleven inches in length. While conventional file section dividers are quite adequate for this purpose, the need often arises for storing papers or other articles formed in a different size within filing compartments designed to receive papers of the particular standard size for which the file section dividers are designed. Smaller papers and articles can thereby easily become crumpled or overlooked when stored in compartments delineated by conventional file section dividers, due to their relatively small size. Smaller papers and other articles stored between conventional file section dividers are also easily overlooked.

This problem is particularly acute in the case of portable, collapsible files where the access to each file section compartment may be rather limited. Small notes and other papers can easily drop down between the larger papers for which the file is designed. The inability to locate such smaller documents and other articles within a portable, expandable filing case represents a course of continuing frustration and annoyance to persons utilizing such articles.

One approach to dealing with this problem was to provide file section dividers for office filing products that are equipped with pockets or pouches designed to receive articles that are smaller in size than the papers or documents that the file section dividers are designed to separate. By providing a pouch or pocket on the surface of a file section divider, the user of the file is able to more quickly and expeditiously locate undersized documents and papers within a filing compartment. Prior U.S. patent application Ser. No. 10/210,983, presently pending, provides such a system and is hereby incorporated by reference in its entirety. However, in that prior system only a single pocket is formed on each pocket divider. The pockets formed within the depicted embodiments of an expandable filing case disclosed in that prior application are all the same size.

SUMMARY OF THE INVENTION

In one broad aspect the present invention may be considered to be an improvement in a file section divider formed as an expansive partition and having a laterally extending upper edge from which a file section label tab projects upwardly, an opposing, laterally extending lower edge parallel to the upper edge, and mutually parallel opposing side edges oriented perpendicular to the upper and lower section divider edges. The improvement of the invention is comprised of a pocket panel secured to the expansive partition. The pocket has a top opening edge located beneath the level of the label tab.

The partition and pocket are preferably both formed of thin sheets of plastic material, such as polyethylene or polypropylene. The expansive partition and the pocket panel are formed from a common sheet of flexible material folded at a bottom edge fold which defines the lower edge of the partition and creates a delineation between the partition and the pocket panel. The pocket panel is thereby formed as an extension from the lower edge of the partition. The pocket panel has a top opening pocket panel edge located beneath the upper edge of the partition.

The side edges of the pocket panel are spaced closer together than the side edges of the partition so that the expansive partition is wider than the pocket panel. The expansive partition has marginal file attachment strips located outboard from the pocket panel side edges. The pocket panel is secured directly to the expansive partition along at least one linear pocket delineation seal that is parallel to the opposing side edges of the pocket panel and which forms an upper termination. The side edges of the pocket panel are sealed directly to the expansive partition inboard from the side edges of the expansive partition by linear pocket side seals. The pocket side seals are parallel to the pocket panel side edges and are located inboard from the marginal file attachment strips.

In some preferred embodiments of the invention the upper termination of the linear pocket delineation seal is beneath the top opening edge of the pocket panel. The pocket panel is split from the upper termination to the top opening panel edge, thereby defining separately manipulatable pocket apron flaps on both sides and above the linear pocket delineation seal. Preferably, the pocket apron flaps are separated by a gap and are slightly smaller in width than the pockets beneath formed on either side of the pocket delineation seal.

Laterally directed notches may be formed in the pocket panel at the apron flap in an inboard direction at each of the pocket side edges and in both lateral directions from each pocket delineation seal.

The position of pocket apron flaps above the pockets formed between the pocket panel and the expansive partition aid a user is inserting objects into the pockets when the file section dividers are located within an expanding file. That is, with an expanding, accordion-type file spread open for access, it is sometimes difficult to insert an object into a pocket formed on one of the expansive partitions since the pocket panel is sealed directly to the partition behind it by a linear seal that tends to hold the pocket panel closely against the partition. Therefore, it is sometimes difficult to insert an object into a pocket defined between the expansive partition and its facing pocket panel, particularly a narrow pocket. This is because the upper edge of the pocket panel is located below the upper edge of the partition and the attachment of the pocket panel to the partition tends to draw the pocket panel into closely facing arrangement with the partition.

By providing pocket apron flaps at the tops of the pocket, a user can grip the flap and thereby pull the upper portion of the pocket panel forming the pocket away from such close proximity to the partition behind it. This increases the size of the mouth of the pocket, thereby facilitating insertion of an object into the pocket. Insertion of an object is facilitated to an even greater degree by forming laterally directed notches in the pocket panel at the apron flaps in an inboard direction at each of the pocket side edges and in both lateral directions from each pocket delineation seal. By constructing the file section divider in this manner the pocket apron-panels are more easily gripped so that they can be used to open the pockets for insertion of objects into the pockets.

One or a plurality of pocket delineation seals may be formed to attach the pocket panel to the expansive partition behind it in order to create the number of pockets desired for each file section divider. If there is only a single pocket delineation seal, only two pockets are formed, one on either side of the pocket delineation seal. If two pocket delineation seals are formed to secure the pocket panel to the expansive partition, three separate pockets will be formed, side by side. Three pocket delineation seals will form four pockets, and so forth.

Pockets may be formed so as to produce a plurality of pockets of equal width. Alternatively, one or more pocket delineation seals may be used to divide the space between the pocket panel and the adjacent, expansive partition to which it is attached into a plurality of pockets of unequal width.

Whatever the number of pockets, it is often advantageous to notch the top opening edge of the pocket panel inboard from each of the pocket panels side edges and on both sides of each linear pocket delineation seal. By notching the top pocket panel edge in this manner the upper edge of each pocket may be more easily drawn back to facilitate insertion of objects into the pockets between the pocket panel and the expansive partition.

In another broad aspect the invention may be considered to be a portable document storage device comprising a case including front and back covers and a plurality of flexible file section dividers. The file section dividers have mutually parallel upper and lower divider edges and opposing, mutually parallel divider side edges oriented perpendicular to the upper and lower divider edges. The file section dividers are joined at the divider side edges to delineate the case into a plurality of filing compartments.

At least some of the file section dividers are provided with upwardly opening pockets, each formed from an extension panel projecting from a separate one of the dividers at the lower edge thereof. Each extension panel is folded back up against the divider from which it extends and terminates at an opposite top opening edge below the upper divider edges. The extension panel has a pair of pocket panel side edges parallel to the side edges of the divider from which the extension panel extends.

At least one of the extension panels in the document storage device is permanently fastened directly to the separate one of the dividers from which it projects, along at least one linear pocket delineation seal. Each pocket delineation seal is parallel to and located between the pocket panel side edges. Each linear pocket delineation seal ends at a pocket delineation termination located beneath the divider upper edges.

In most cases the pocket panel side edges are secured to the dividers inboard from the divider side edges by linear side pocket seals parallel to the pouch panel side edges. The pocket panel thereby forms pockets and also pocket apron flaps above the pockets at locations beneath the upper file section divider edges. The pockets are thereby closed at all their sides and are accessible by deflecting the pocket apron flaps away from the file section dividers.

Each pocket delineation termination is preferably located a spaced distance from the top opening edge of its associated extension panel. The extension panel is split between the top opening edge and the pocket delineation seal termination to define separately manipulatable pocket apron flaps above and on opposing sides of the pocket delineation seal termination. The pocket apron flaps are preferably notched laterally adjacent all of the pocket delineation seals and at the pouch panel side edges.

The pocket apron flaps project upwardly from their corresponding pockets. Preferably, each pocket apron panel is narrower in width than the corresponding pocket from which it projects so that narrow gaps exist between each of the pocket apron flaps. Also, the pocket apron flaps are preferably notched laterally adjacent all of the pocket demarcation seals and at the pouch panel side edges. This creates a slightly narrowed neck in the pocket apron flaps which enhances their flexibility. A user is thereby able to deflect them with greater facility to insert and remove articles from the pockets.

For some uses pockets of equal width on each file section divider are preferable. In that case all pocket delineation seals are spaced equidistant from the pocket side seals or other pocket delineation seals on either side. For other uses, pockets of unequal width are preferable. In that case, each of the pocket delineation seals is not equally spaced from the pocket panel side edges and from other pocket delineation seals. In file section dividers having two pockets of unequal width, located side by side, the pocket delineation seal is located closer to one of the pocket panel side edges than to the other. For some uses, more than two pockets on a file section divider are provided. A plurality of the linear pocket delineation seals are thereby required on a file section divider in which more than two pockets are created.

The upper panel edge may be a straight, horizontal edge, parallel to the lower edge of the expansive partition of the file section divider. Alternatively, the upper panel edge may be arcuately curved concave upward on both sides of each pocket delineation seal. Notches are preferably defined in each upper pocket panel edge on both sides of each pocket delineation seal and just inboard from the pouch side seals. In still another alternative arrangement the upper panel edge is curved arcuately downward on both sides of the pocket delineation seal. Notches are defined in each upper panel edge on both sides of each pocket delineation seal and just inboard of each pocket panel side seal.

The file section dividers of the invention find their greatest utility when employed in a collapsible and expandable filing case. Typical expandable filing cases may be of the wallet style of the type described in prior U.S. Pat. No. 6,607,122, which is hereby incorporated by reference in its entirety. Another type of expandable filing case in which file section dividers of the invention may be advantageously employed are combined structures, such as an expanding file with removable tote box, as described in prior U.S. patent application Ser. No. 10/643,851 filed Aug. 20, 2003, presently pending. This prior patent application is also hereby incorporated by reference in its entirety. Still another type of expanding filing case in which file section dividers according to the invention may be advantageously utilized is a combined file pocket and expanding file of the type described in prior U.S. Pat. No. 6,669,080. This prior patent is also hereby incorporated by reference in its entirety.

In another broad aspect the invention may also be considered to be an improved expandable filing case of the type having a plastic front cover and a plastic back cover, plastic side panels extending between the front and back covers, and a plurality of file section dividers. Both the front and back cover of the filing case have a top and a bottom. Each side panel has a plurality of accordion folded pleats formed therein. Each pleat is formed with a pair of first and second facing surfaces that are collapsible toward each. The plurality of plastic file section dividers have opposing, mutually parallel, upper and lower divider edges and opposing, mutually parallel, outboard divider side edges. The divider side edges are oriented perpendicular to the upper and lower divider edges. Each of the section dividers has side edge margins extending between the upper and lower divider edges and located immediately adjacent to the divider side edges. Each of the side edge margins is sealed to a single one of the facing surfaces in the pair of facing surfaces formed by the pleats to create folded pleated connections. The section dividers are thereby coupled to the front and back covers by means of the side panels.

At least one of the file section dividers is provided with a pocket panel extending from the lower edge thereof. The pocket panel is folded upwardly from the lower divider edge of the file section divider from which it extends. The pocket panel terminates at an upper pocket panel edge located beneath the upper divider edge of the file section divider from which the pocket panel extends. The pocket panel has pocket panel side edges parallel to and inboard from the divider side edges. The pocket panel is sealed directly to the file section divider from which it extends by at least one linear pocket delineation seal. Each pocket delineation seal is located between and extends parallel to the pocket panel side edges. The linear pocket delineation seal has an upper terminus located below the upper pocket panel edge. The pocket delineation seal thereby creates a plurality of separate, laterally adjacent pockets.

The invention may be described with greater clarity and particularity by reference to the accompanying drawings.

DESCRIPTION OF THE EMBODIMENTS

Figure 1:
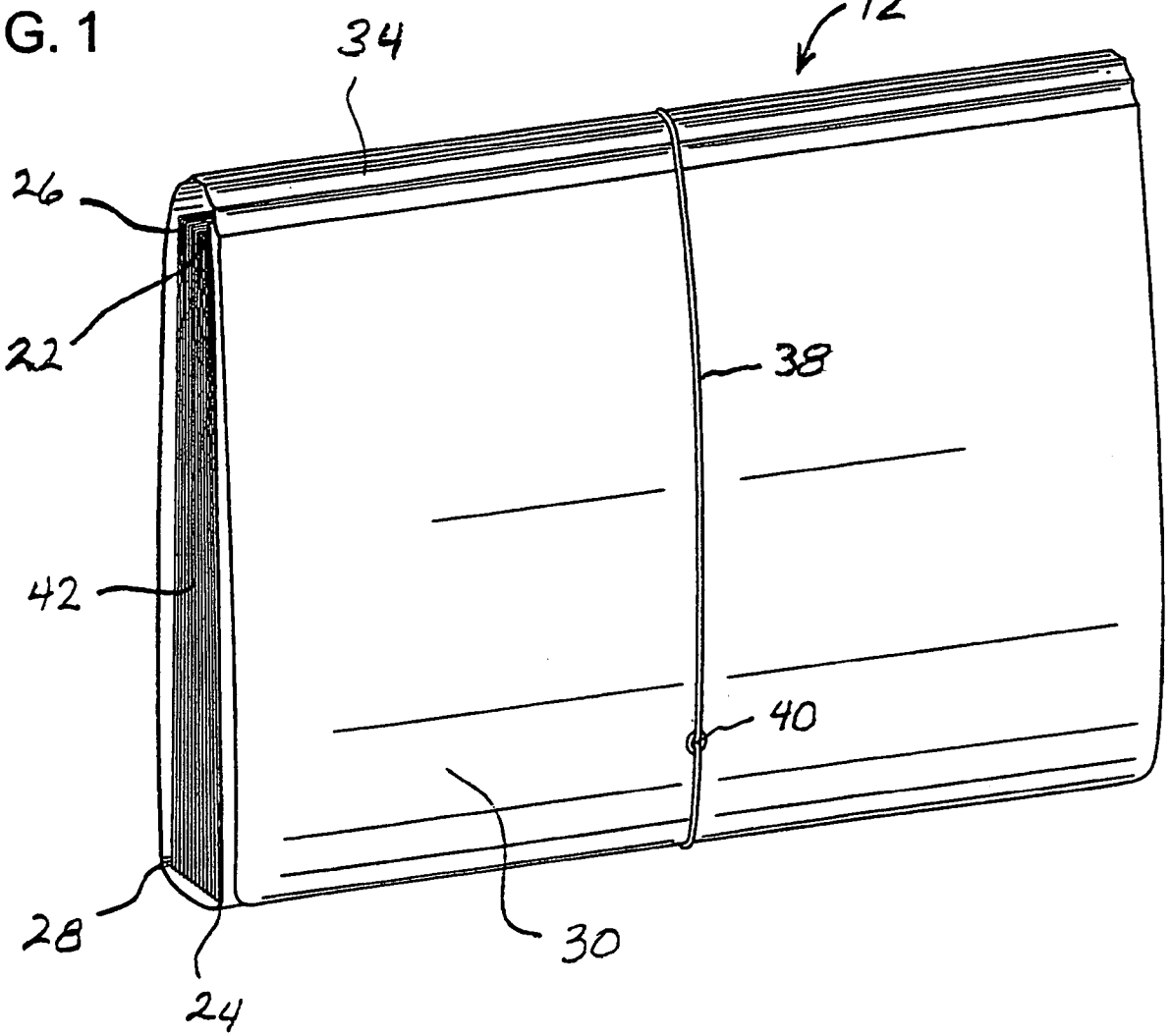
FIG. 1 illustrates a typical wallet-type expandable filing case in which file section dividers according to the invention are employed, shown in a closed condition.

FIG. 1 illustrates a portable document storage device which is an expandable wallet-type filing case 12. The filing wallet 12 has a large, generally rectangular front cover 18, visible in FIG. 2, and a large, generally rectangular back cover 20 shown in FIG. 3. A bottom panel 14 extends between the front cover 18 and back cover 20. Both the front cover 18 and the back cover 20 have a top and a bottom. The top of the front cover 18 is indicated at 22 in FIGS. 2 and 3, while the bottom the front cover 18 is indicated at 24. The top of the back cover 20 is indicated at 26, while the bottom of the back cover 20 is indicated at 28. The file folder 12 has a large folding flap 30 that is foldable over the top 22 of the front cover 18 as illustrated in FIG. 1.

The front cover 18, bottom panel 14, back cover 20, and folding flap 30 are all formed as parts of a single base sheet of stiff, but flexible plastic material, such a polypropylene or polyethylene, preferably about fifty mils in thickness. In the embodiment of the filing wallet 12 shown, the bottom closure panel 14 is formed from the same plastic base sheet as the front and back covers 18 and 20. A single stiff sheet of covering material is folded along the bottom edge 24 of the front cover 18 to delineate the front cover 18 from the bottom panel 14 and along the bottom edge 28 of the back cover 20 to delineate the bottom panel 14 from the back panel 20. An articulated closure top 34 is also defined on the same base sheet of plastic material. An articulated fold at the top edge 26 of the back cover 20 delineates the back cover 20 from the top panel 34. An articulated fold at 36 delineates the top panel 34 from the closure flap 30. The top panel 34 is formed with a series of articulated folds so as to accommodate various thickness of documents within the file folder 12.

The folding flap 30 is provided with an elastic loop 38 that is secured at a grommet 40 near the free edge of the folding flap 30, remote from the delineating articulated fold 36. The elastic loop 38 can be stretched to envelope the entire structure of the portable document storage wallet 12 so that it can be transported in a very compact and secure manner, as illustrated in FIG. 1.

Figure 2:
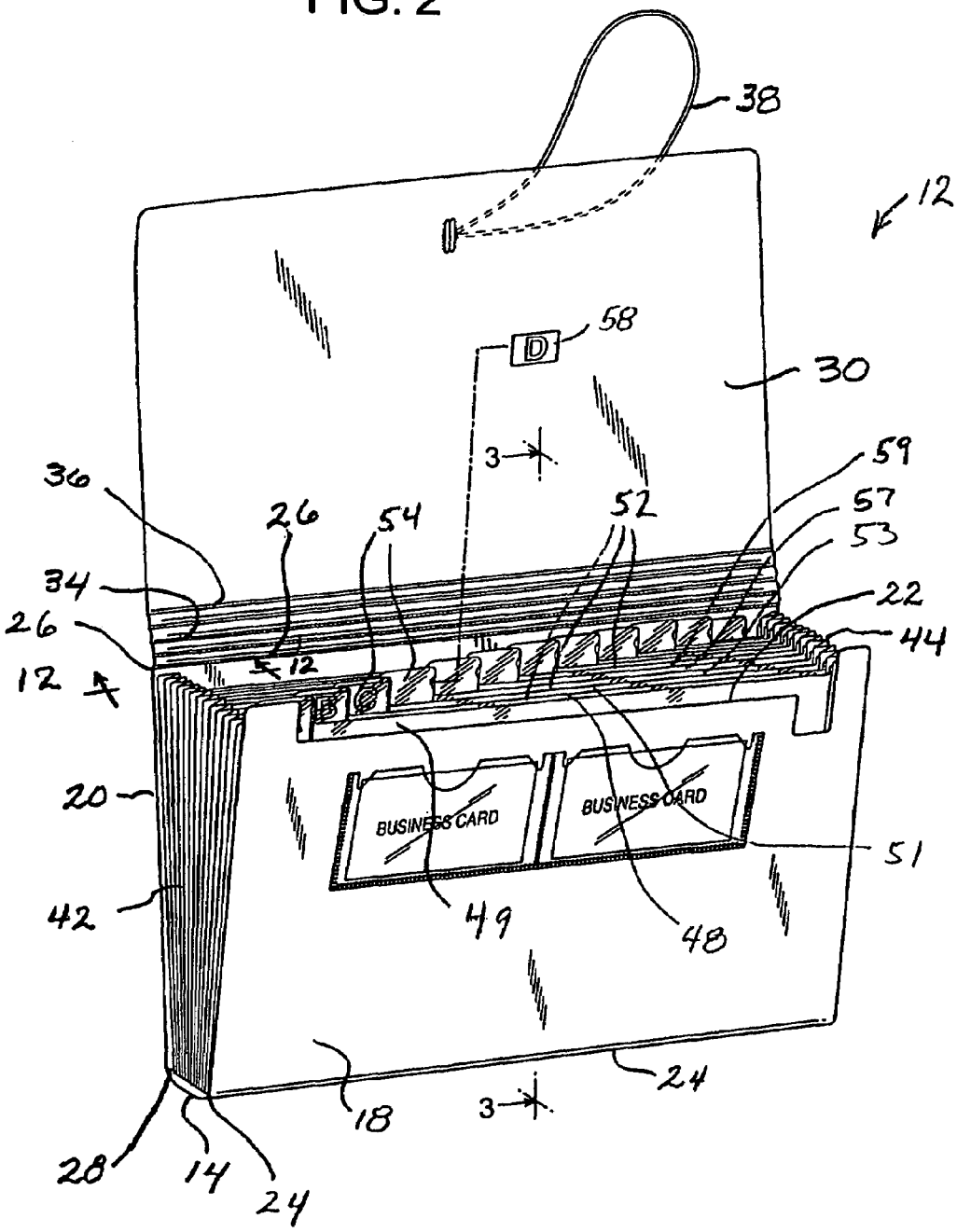
FIG. 2 illustrates the expandable filing case of FIG. 1 with its closure flap opened and in an expanded condition.
Figure 3:
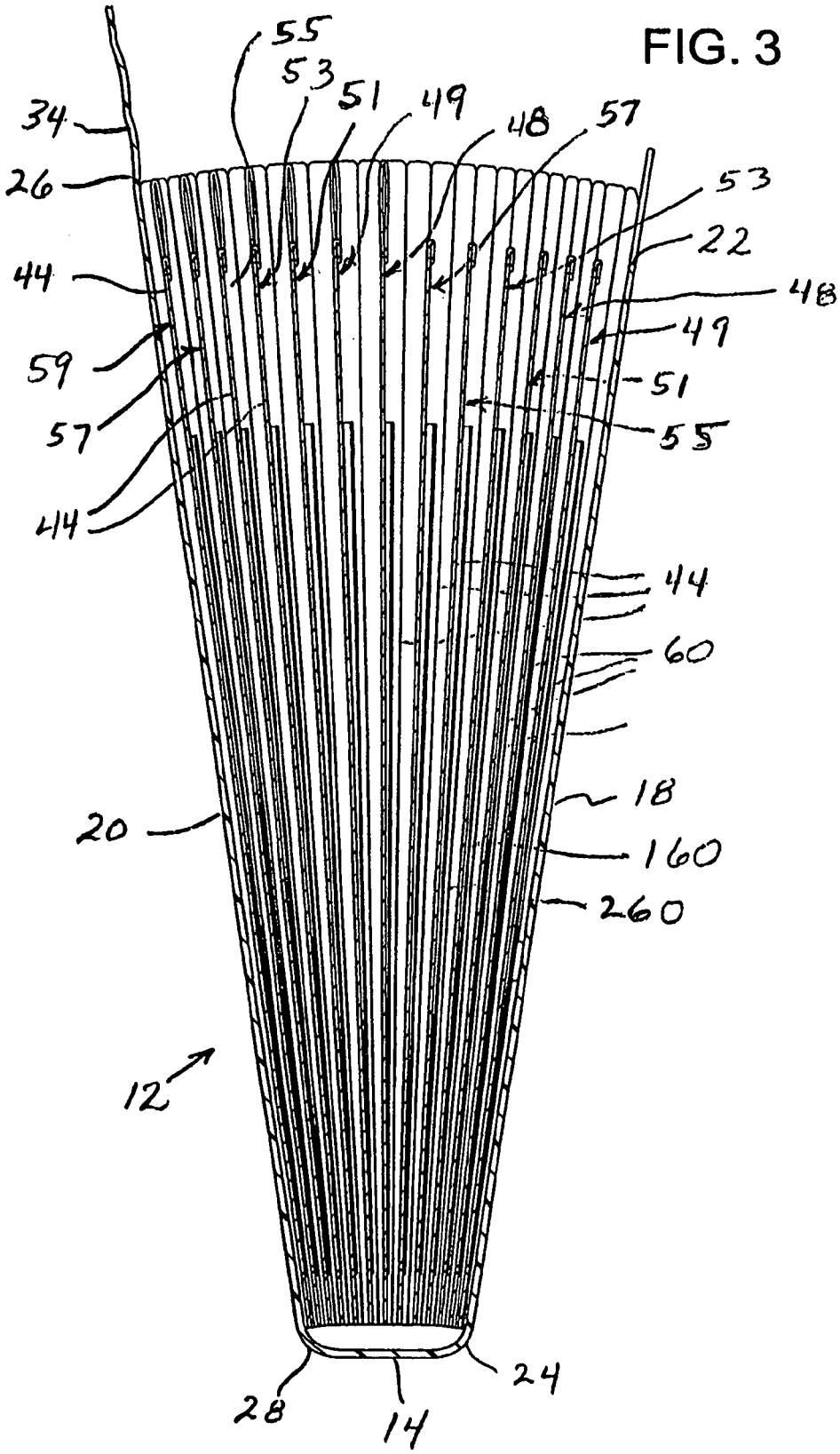
FIG. 3 is side sectional view taken along the lines 3—3 of FIG. 2.
Figure 12:
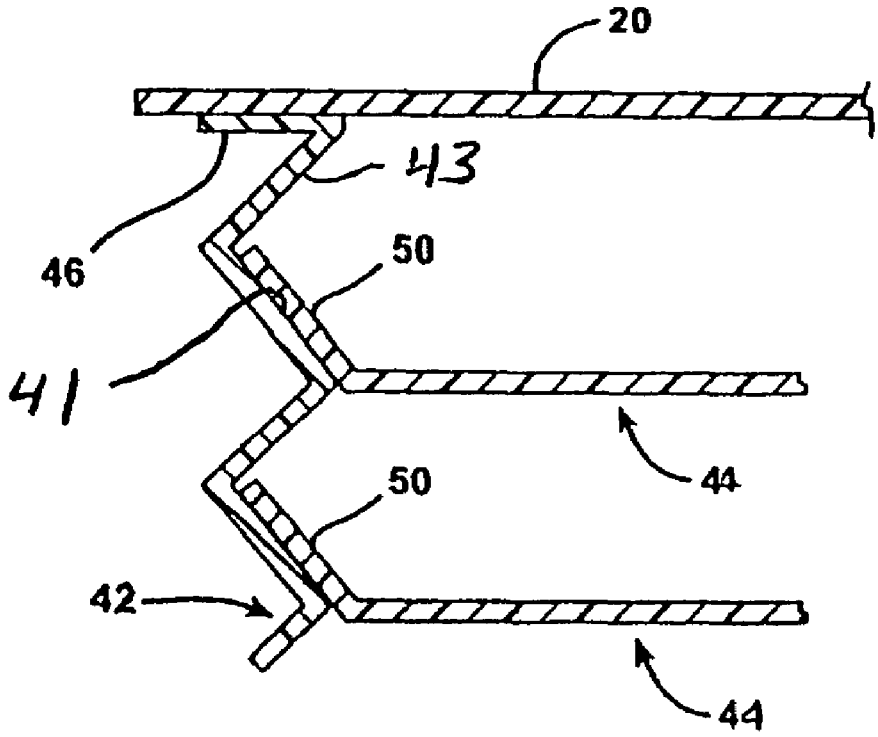
FIG. 12 is a sectional detail taken at 12—12 in FIG. 2.

The filing wallet 12 is also provided with side panel sheets 42 and 44, also formed of polypropylene or polyethylene plastic. In the embodiment of the portable document storage wallet 12 depicted in FIGS. 1–3, the side panel sheets 42 and 44 originally have a rectangular shape, but are folded back and forth along vertical folds in alternating directions to form a plurality of accordion pleats, as best illustrated in FIGS. 2, 3, and 12. When the collapsible accordion wallet 12 is fully expanded, as illustrated in FIG. 3, the tops of each fold in the side panel sheets 42 and 44 is about nine-sixteenths of an inch from the next adjacent fold, as measured along the top edges of the side panels 42 and 44.

The front and back ends of each of the side panels 42 and 44 form thin, narrow, elongated attachment strips 46, illustrated in FIG. 12. The opposing end margins of the side panel sheets 42 and 44 that form the attachment strips 46 are folded to reside in intimate contact with the mutually facing surfaces of the front and back covers 18 and 20. The attachment strips 46 are heat or sonic welded from top to bottom to the facing surfaces of the front cover 18 and back cover 20, as best illustrated in the sectional detail of FIG. 12. The attachment strips 46 extend the entire length of the side panel sheets 42 and 44 and are sealed from top to bottom throughout their lengths from near the bottom edges 24 and 28 to the near the top edges 22 and 26 of the front cover 18 and back cover 20.

As shown in FIGS. 2, 3, and 12, each side panel pleat is formed with a pair of facing surfaces 41 and 43 that are collapsible toward each other. The rearwardly facing surfaces 41 may be considered to be first surfaces while the forwardly facing surfaces 43 may be considered to be the second surfaces of each pair of surfaces forming each pleat.

A plurality of plastic file section dividers 48, 49, 51, 53, 55, 57, and 59 constructed according to the invention are utilized in the expandable wallet filing case 12. It is to be understood that, while the filing case 12 is illustrated as employing all of these different types of file section dividers, an expandable filing case according to the invention can be constructed employing a plurality of but a single one of the types of file section dividers illustrated in drawing FIGS. 4–11. Alternatively, an expandable filing case according to the invention can be constructed utilizing any combination of different ones of the file section dividers illustrated in FIGS. 4–11.

Each of the file section dividers 48, 49, 51, 53, 55, 57, and 59 is formed of a stiff sheet of polyethylene or polypropylene having an expansive back partition 44 defining an upper edge 52, a lower edge 54, and mutually opposing divider side edges 45 and 47. The side edges 45 and 47 are both perpendicular to the upper edge 52 and lower edge 54. The interior portion of the upper edge 52 may be recessed downwardly below the transverse, laterally separated extremities of the file section divider partition 44.

Indexing label tab holders 54 may be heat welded at different locations along the transverse width of the file section divider partitions 44. Each of the indexing tab holders 54 is formed of a doubled over piece of plastic, the bottom edges of which are heat welded to the top edges 52 of the file section divider partitions 44. Small gripping notches 56 are provided at the opposing side edges of each tab holder 54 on one side thereof to facilitate separation of the two plys of plastic forming the tab holder 54. The tab holder 54 thereby receives as inserts selected thin paper labels 58 therein, as illustrated in drawing FIGS. 4–11. The file indexing tab holders 54, together with their index labels 58, thereby form a readily visible indexing system for the contents of the collapsible wallet file 12, as best illustrated in FIG. 2.

Each of the file section divider partitions 44 is folded vertically at its transverse ends to form narrow, elongated side edge margin strips 50 which extend the entire height of the partition 44. The side edge margins 50 of the file section divider partitions 44 are ultimately heat welded to the first surfaces 41 in each pleat of the side panel sheets 42 and 44 throughout between the upper and lower divider partition edges 52 and 54 of the expansive partitions 44, as best illustrated in FIG. 12.

As shown in that drawing figure, the side edge margins 50 of the partitions 44 of each of the file section dividers 48, 49, 51, 53, 55, 57, and 59 are individually secured to the side panel sheets 42 and 44 at separate pleats of the accordion folds as illustrated in FIG. 12. Each side edge margin 50 is heat welded or sonic welded to a separate one of the first surfaces 41 in each pair of surfaces 41 and 43 in each side panel pleat.

While the file section divider partitions 44 of the different file section dividers illustrated in FIGS. 5–11 are substantially identical to each other, except for the placement of the index label tab holders 54 along the top edges 52 thereof, the construction of each file section divider 48, 49, 51, 53, 55, 57, and 59 is different.

Figure 5:
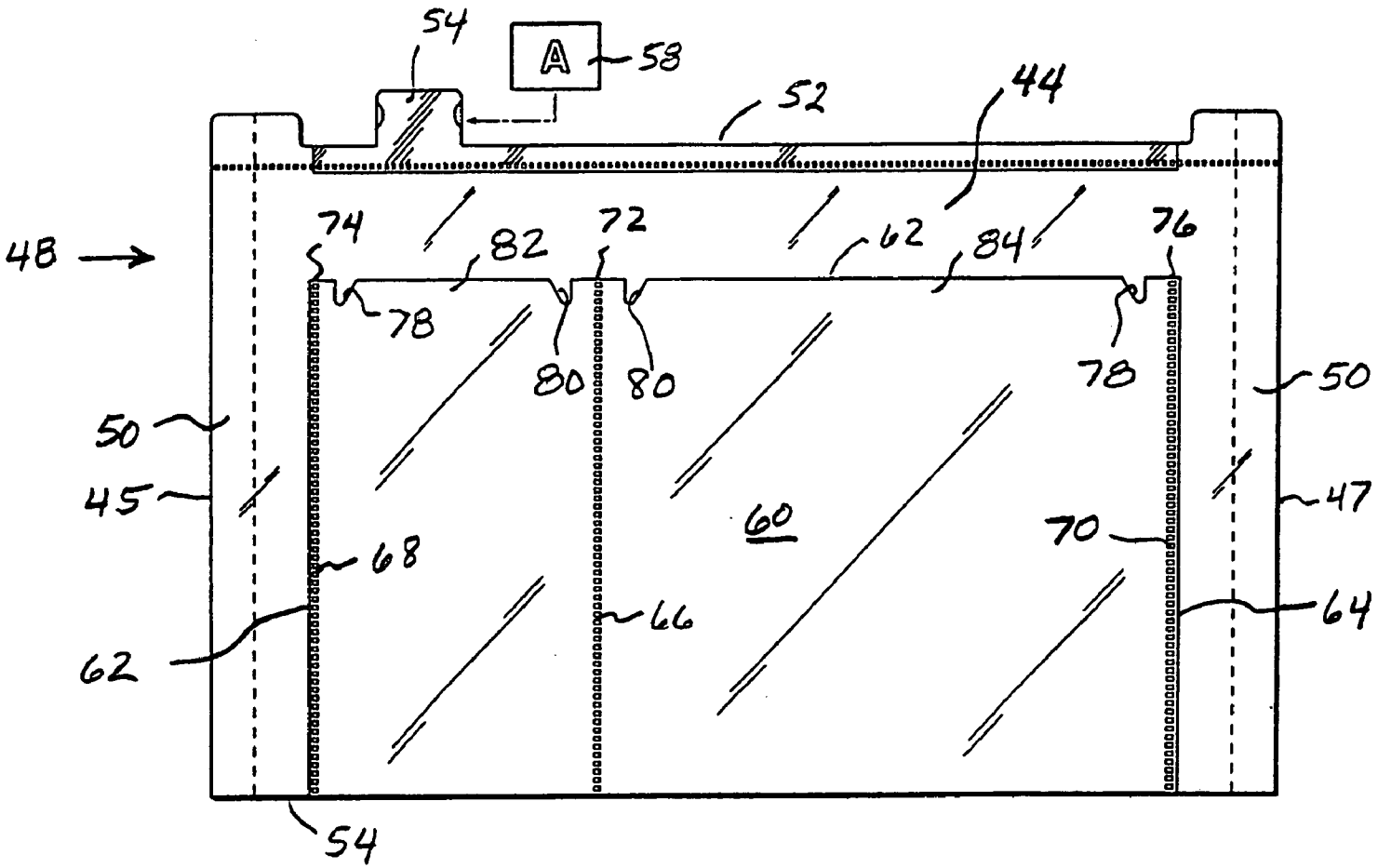
FIG. 5 is a front elevational view illustrating the completed file section divider of FIG. 4.

The file section divider 48 has a pocket panel 60 that is secured to the divider partition 44. More specifically, the expansive panel 44 and pocket panel 60 are formed from a common sheet of flexible material that is folded at a bottom edge fold along the lower edge 54 of the partition 44. This fold defines the lower edge of the partition 44. The pocket panel 60 has a top opening pocket panel edge 62 located beneath the upper edge 52 of the partition 44 when the pocket panel 60 is folded upwardly into facing relationship and joined to the partition 44, as illustrated in FIG. 5. When the pocket panel 60 is folded upwardly to position of FIG. 5, its mutually parallel side edges 62 and 64 are parallel to the side edges 45 and 47 of the divider partition 44. The side edges 64 and 62 of the pocket panel 60 are spaced closer together to each other than the side edges 45 and 47 of the partition 44. The expansive partition 44 is thereby wider than the pocket panel 60. The marginal file divider attachment strips 50 of the partition 44 are thereby located outboard from the pocket panel side edges 62 and 64.

The pocket panel 60 is secured directly to the partition 44 from which it extends at several locations. Specifically, the pocket panel 60 is secured to the partition 44 from which it extends and against which it is folded by at least one linear pocket delineation seal 66 that is parallel to the opposing side edges 62 and 64 of the pocket panel 60. The pocket panel 60 is also secured to the partition 44 by linear pocket side seals 68 and 70 that are parallel to the side edges 62 and 64 of the pocket panel 60.

The linear pocket side seals 68 and 70 and the single pocket delineation seal 66 employed in the file section divider 48, illustrated in FIGS. 4 and 5, extend throughout the length of the pocket panel 60 and terminate below the top edge 52 of the partition 44. The pocket side seals 68 and 70 are located inboard from the marginal file attachment strips 50 of the partition 44. The linear seals 66, 68, and 70 may all be formed in a single heat welding or sonic welding operation to delineate a pair of mutually adjacent pockets on either side of the pocket delineation seal 66. The side edges 62 and 64 of the pocket panel 60 are spaced closer together than the side edges 45 and 47 of the partition 44 so that the partition 44 is wider than the pocket panel 60. The side edges 62 and 64 of the pocket panel 60 are sealed directly to the expansive partition 44 inboard from the side edges 45 and 47 of the partition 44.

The single pocket delineation seal 66 employed in the file section divider 48 is located closer to the pocket panel edge 62 than to the pocket panel edge 64. The pocket delineation seal 66 thereby divides the pocket panel 60 to produce a plurality of pockets of unequal width. That is, the pocket on the right-hand side of the panel section divider 48, as viewed in FIGS. 4 and 5, is wider than the pocket on the left-hand side of the pocket delineation seal 66.

The top opening edge 62 of the pocket panel 60 is notched inboard from each of the pocket panel side edges 62 and 64 with side notches 78, and on both sides of the linear pocket delineation seal 66 with notches 80. By notching the upper edge 62 of the pocket panel 60 at the lateral extremities of the pockets, pocket panel apron tabs 82 and 84 are created. The pocket panel apron tabs 82 and 84 may thereby be deflected away from the partition 44 to facilitate insertion and removal of articles to the pockets formed in the file section divider 48 on each side of the pocket demarcation seal 66 and between the pocket side seals 68 and 70.

The sizes of the pockets formed in any of the file section dividers may be particularly suitable for articles that differ in size and shape. For example, the pocket formed in the file section divider 48 to the left of the pocket panel delineation seal 66 may snugly accommodate a promotional brochure formed from a single sheet of letter-size paper folded into thirds. The pocket formed to the right side of the pocket delineation seal 66 in the file section divider 48 may accommodate a five inch by seven inch photograph, for example.

Figure 6:
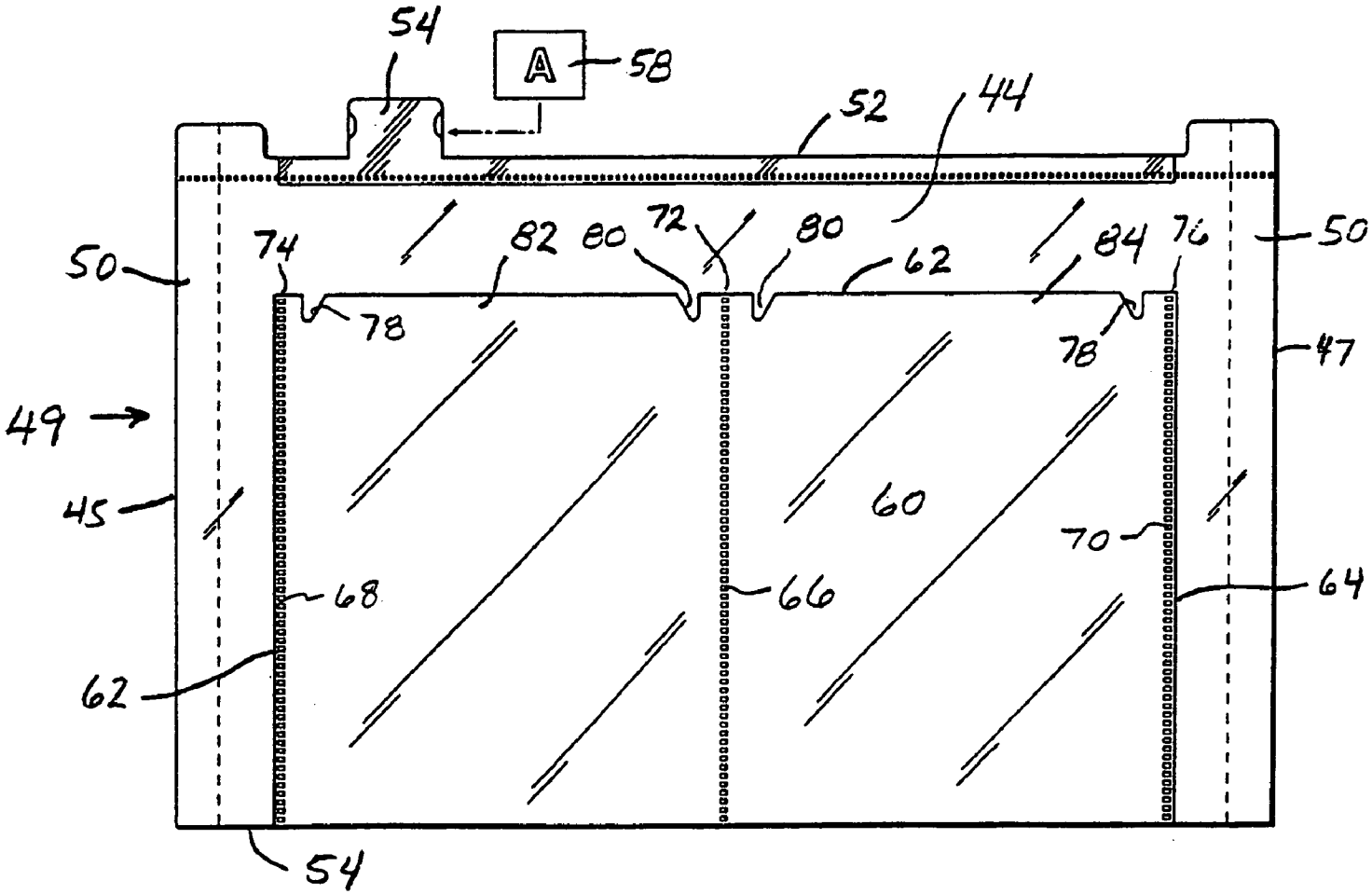
FIG. 6 is a front elevational view showing an alternative embodiment of a section divider according to the invention, in which the adjacent pockets formed are of equal width.

FIG. 6 illustrates an alternative file section divider 49 constructed according to the invention. The file section divider 49 differs from the file section divider 48 in that the linear pocket delineation seal 66 is located midway between the linear pocket side seals 68 and 70. As a consequence, the pockets formed between the pocket panel 60 and the partition 44 from which it extends are equal in both width and height.

Figure 7:
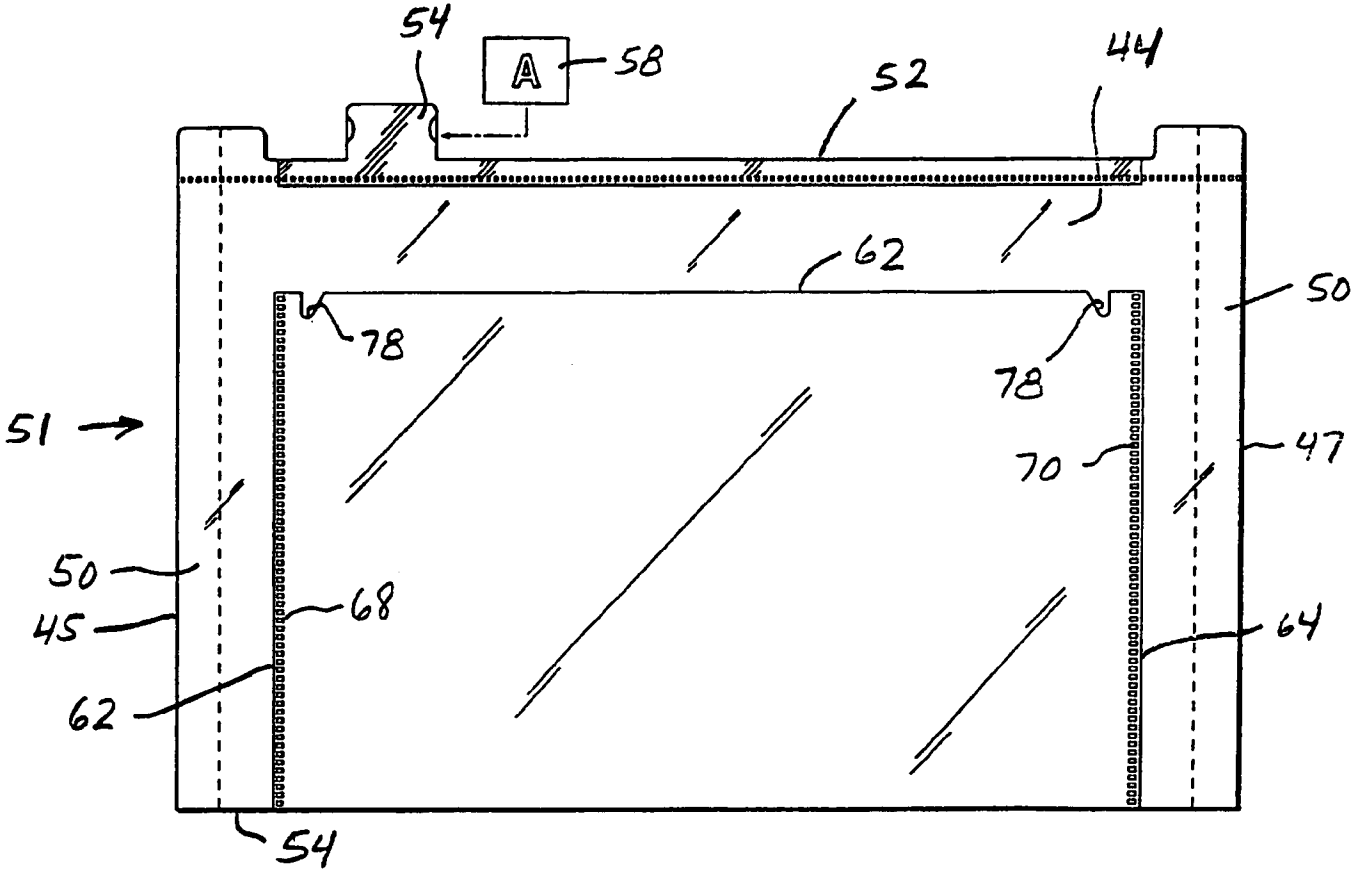
FIG. 7 is a front elevational view showing a file section divider having but a single pocket that may be employed in the expandable filing case shown in FIGS. 1–3.

While at least one, and more typically a plurality of file sections dividers employed in the expandable filing case 12 will have a plurality of pockets, it is not necessary for all file section dividers to be constructed in this manner. For example, FIG. 7 illustrates a file section divider 51 which has a single pocket formed between the linear pocket side seals 68 and 70. This pocket is not subdivided by any pocket delineation seal.

Figure 8:
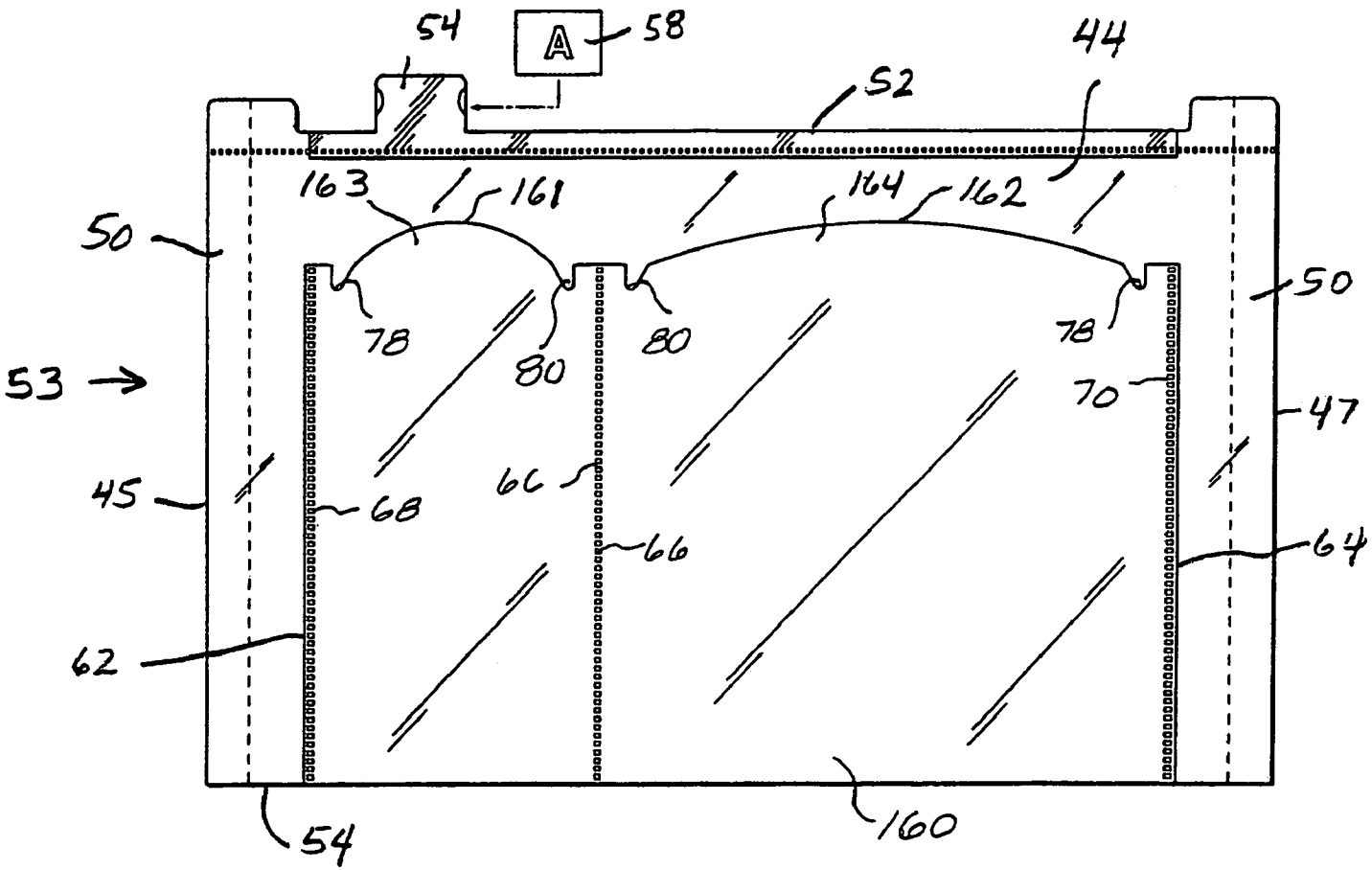
FIG. 8 is a front elevational view illustrating an alternative embodiment of a file section divider according to the invention.

FIG. 8 illustrates a file section divider 53 in which the upper panel edge of the pocket panel 160 is arcuately curved convex upwardly on both sides of the pocket delineation seal 68 as indicated at 161 and 162. The pocket apron tabs 163 and 164 that are thereby formed project upwardly from the upper terminations of the pocket delineation seal 66 and the pocket side seals 68 and 70. A user will typically find it easier to grip apron tabs 163 and 164 that project upwardly above the level of the seal terminations. As in the embodiment of FIGS. 4–7, the file section divider 53 is constructed with notches 80 defined on both sides of the pocket delineation seal 66. Notches 78 are also defined just inboard from the pocket side seals 68 and 70.

Figure 9:
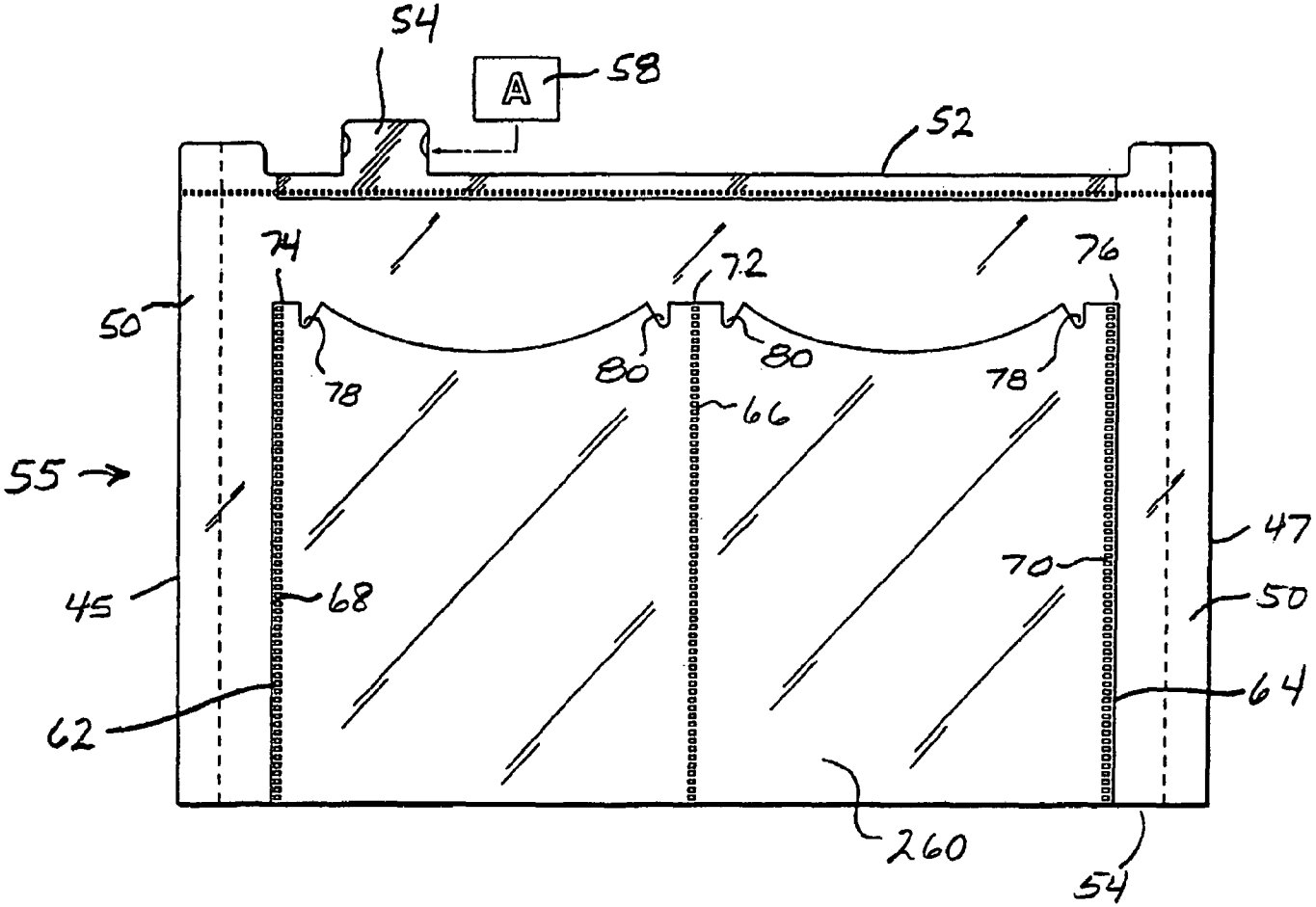
FIG. 9 is a front elevational view illustrating still another alternative embodiment of a file section divider according to the invention.

FIG. 9 illustrates another alternative embodiment of the invention which is a file section divider 55. In this embodiment the upper pocket panel edge of the pocket panel 260 curves arcuately concave downwardly on both sides of the pocket delineation seal 66. A user sometimes finds it advantageous in removing items from a pocket with scooped upper edges as in the file section divider 55. For example, the pockets of the file section divider 55 are configured to receive CD discs. By providing a space at the center of each pocket at which the discs may be gripped, insertion, and particularly removal, of the discs is facilitated considerably. As in the other embodiments, the file section divider 55 has notches 80 in the upper edge of the pocket panel 260 adjacent both sides of the pocket delineation seal 66. Notches 78 are also formed at the opposite sides of the pockets, immediately inboard of the pocket side seals 68 and 70.

Figure 10:
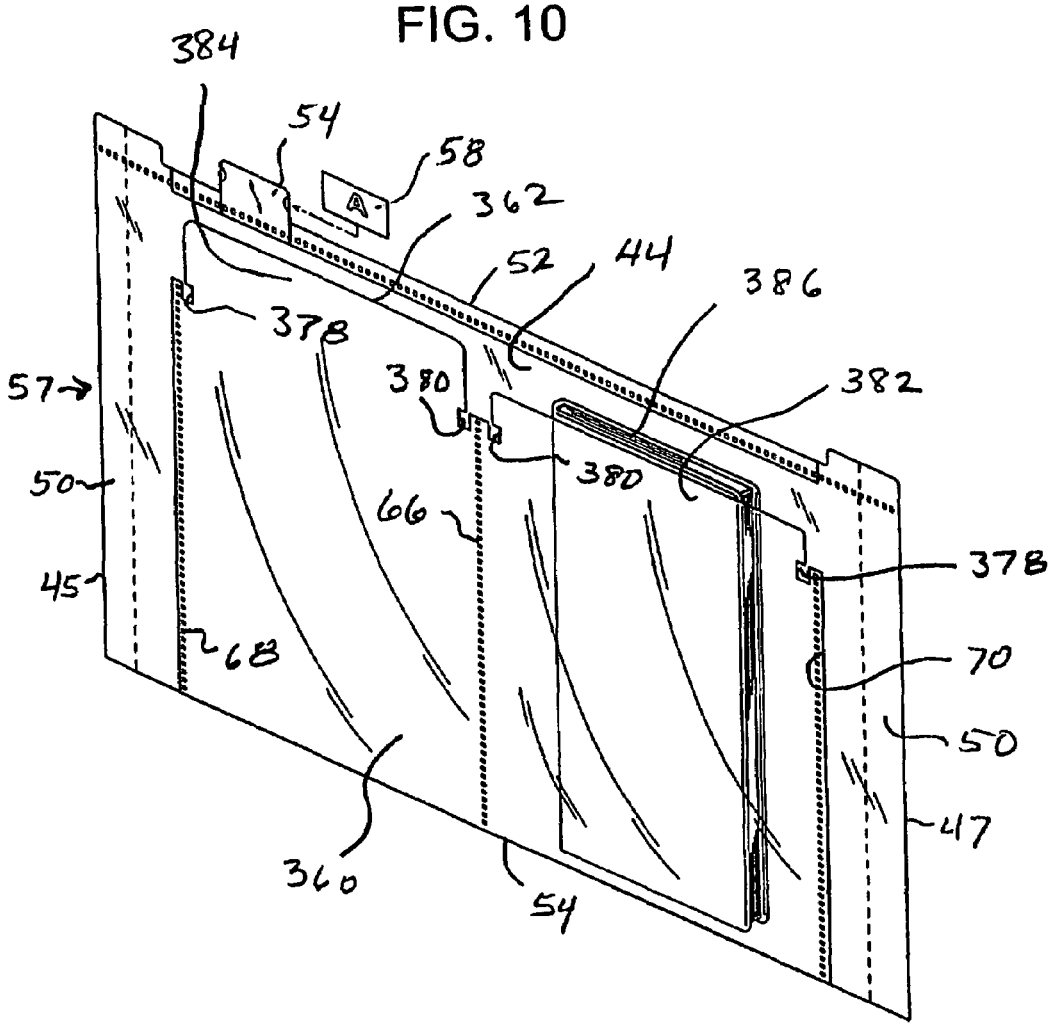
FIG. 10 is a perspective view illustrating still another alternative embodiment of a file section divider according to the invention.

The file section divider 57 illustrated in FIG. 10 has a pocket panel 360 folded up against the partition 44 and sealed thereto by a single, centrally located pocket delineation seal 66 and a pair of laterally spaced pocket side seals 68 and 70. All of the pocket seals 66, 68 and 70 terminate to form pocket panel apron flaps 382 and 384.

The upper termination of the linear pocket delineation seal 66 is beneath the top opening edge 362 of the pocket panel 360. The pocket panel 360 is split from the upper termination of the pocket delineation seal 66 to the top opening panel edge 362, thereby defining separately manipulatable pocket apron flaps 382 and 384 on both sides of the linear pocket delineation seal 66. Laterally directed notches 380 are formed in the pocket panel 360 at the apron flaps 382 and 384 in both lateral directions from the pocket delineation seal 66. At the outside edges of the pockets, laterally directed notches 378 are formed in the pocket panel 360 at the apron flaps 382 and 384 in an inboard direction. The pocket apron flaps 382 and 384 are thereby formed with a slightly necked down region that facilitates manual manipulation of the pocket apron tabs 382 and 384. This construction makes it easier to insert and remove articles from the pockets of the file section divider 57. The provision of very easily manipulable pocket apron flaps 382 and 384 is particularly helpful in the insertion of relatively thick objects, such as the book 386 illustrated in FIG. 10.

Figure 11:
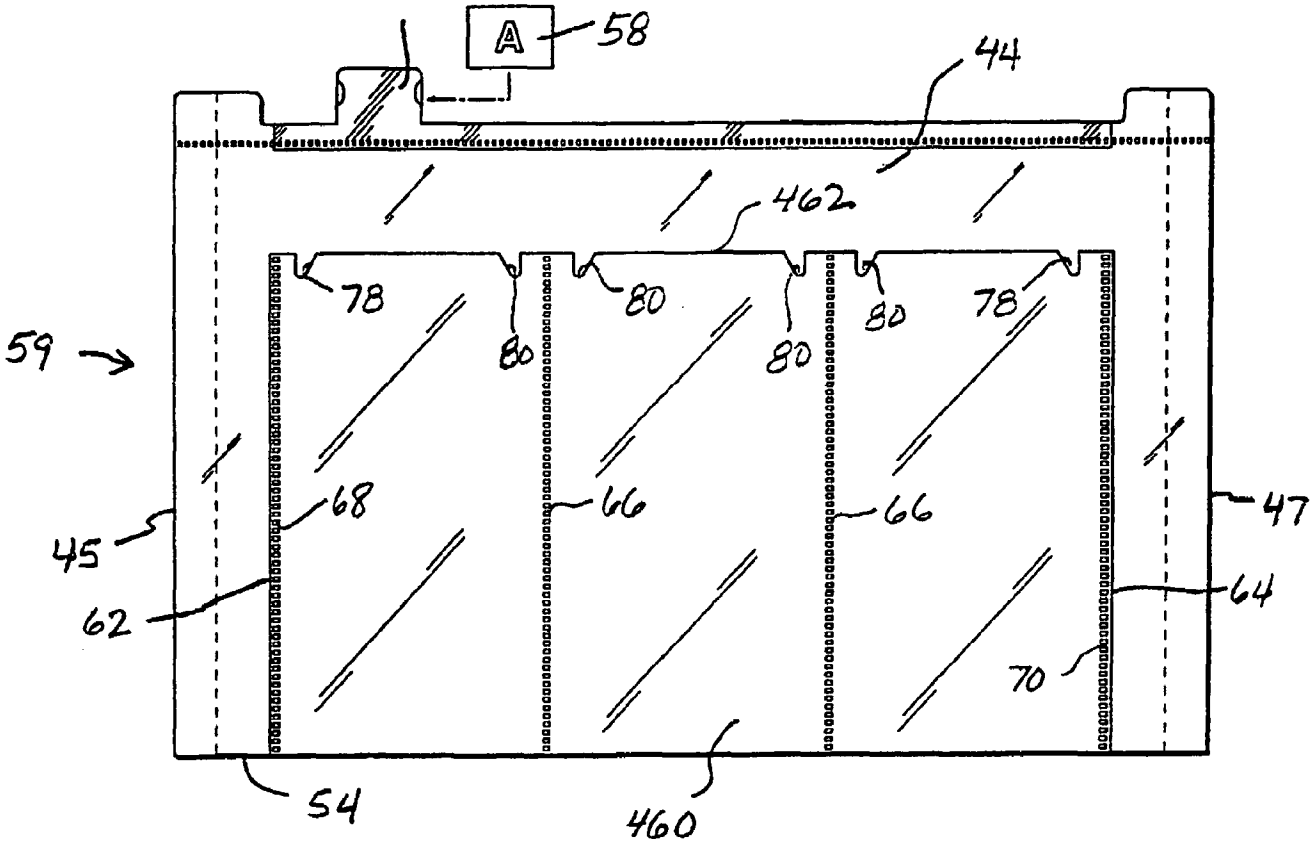
FIG. 11 is a front elevational view illustrating yet another embodiment of a file section divider according to the invention.

The file section divider 59 illustrated in FIG. 11 has a plurality of pocket delineation seals 66 between the side pocket seals 68 and 70. Consequently, the file section divider 59 is divided up into three mutually adjacent pockets located side by side, rather than only two adjacent pockets as in most of the other embodiments of file section dividers illustrated. The two pocket delineation seals 66 that secure the pocket panel 460 to the partition 44 between the pocket side seals 68 and 70 are laterally spaced equally from each other and equally from the adjacent pocket side seals 68 and 70. Consequently, three pockets of uniform width and height are formed in the file section divider 59. The upper edge 462 of the pocket panel 460 is notched at 78 and 80 at the upper edge 462 to facilitate insertion and removal of objects from the pockets formed in the file section divider 59.

As previously noted, each of the marginal side strips 50 of the several file section divider partitions 44 is secured by heat or sonic welding to a separate one of the faces 41 of the pleats formed in the filing case side panel 42 and 44. There is a very important manufacturing advantage for the side edge margins 50 to be sealed to the corresponding surfaces 41 on the inside surfaces of the side panels 42 and 44. More specifically, all of the side edge margins 50 of the file divider partitions 44 can be fused simultaneously to the first surfaces 41 of the pleats of the side panels 42 and 44.

Figure 4:
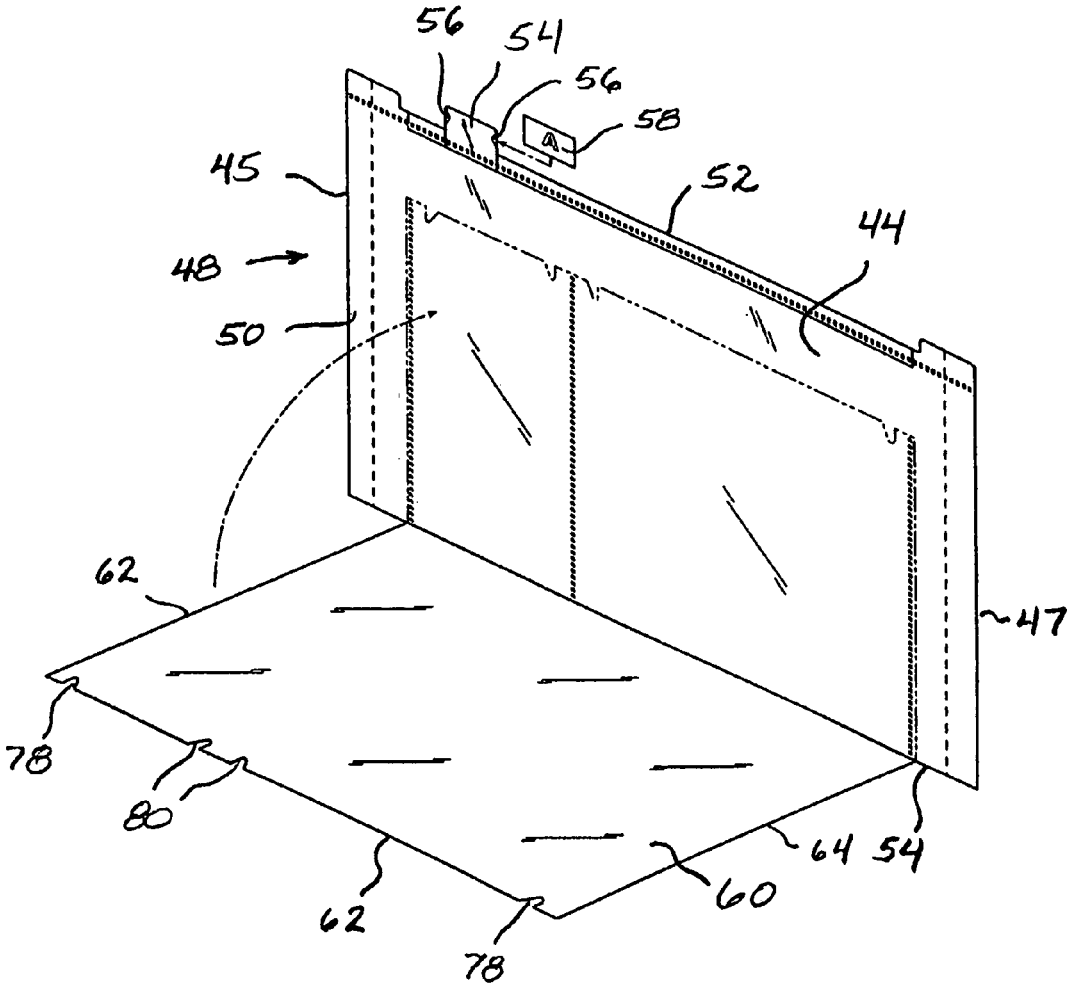
FIG. 4 is a perspective view of one embodiment of a file section divider according to the invention, shown at an intermediate stage of construction.

The various file section dividers 48, 49, 51, 53, 55, 57, and 59 are first constructed by folding their respective pocket panels up against an expansive partition 44, in the manner illustrated in FIG. 4. The side pocket panel seals 68 and 70 and the pocket delineation seal or seals 66 are then concurrently formed as each file section divider is formed.

Figure 13:
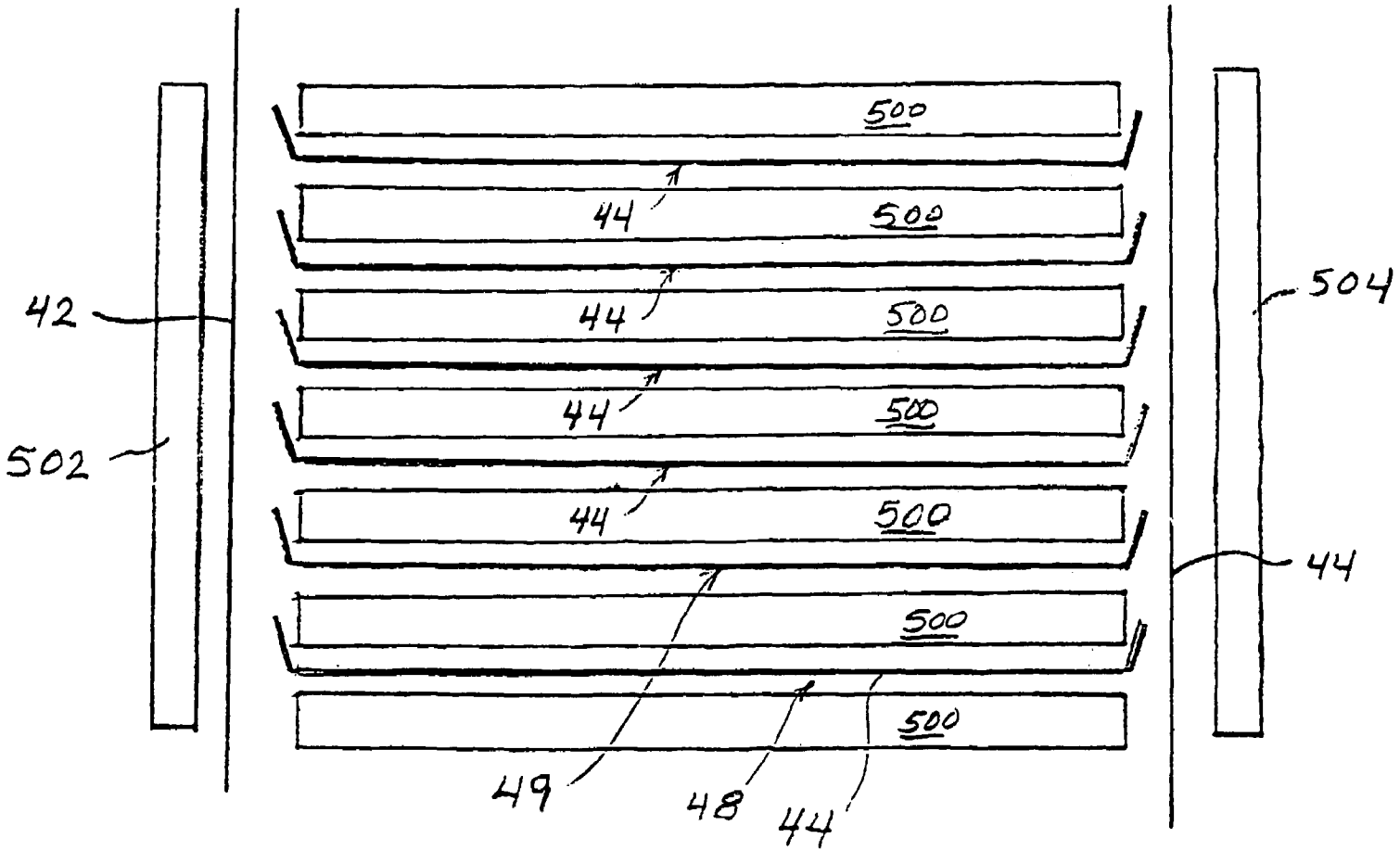
FIG. 13 is a top plan diagrammatic view illustrating an initial step in the attachment of the dividers of FIGS. 4–11 in the file case of FIGS. 1–3.

Once all of the pockets have been formed in the file section dividers, the side edge marginal strips 50 of each of the partitions 44 of each of the file section dividers are bent into an obtuse angle relative to the main, central region of each of the file section dividers. The main, central regions of the file section dividers 48, 49, 51, 53, 55, 57, and 59 are then separated from each other by metal spacer slabs 500, as illustrated in FIG. 13. The plastic sheets from which the side panels 42 and 44 are formed are then inserted in between the bearing blocks 502 and the side edge margin strips 50, also illustrated in FIG. 13.

Figure 14:
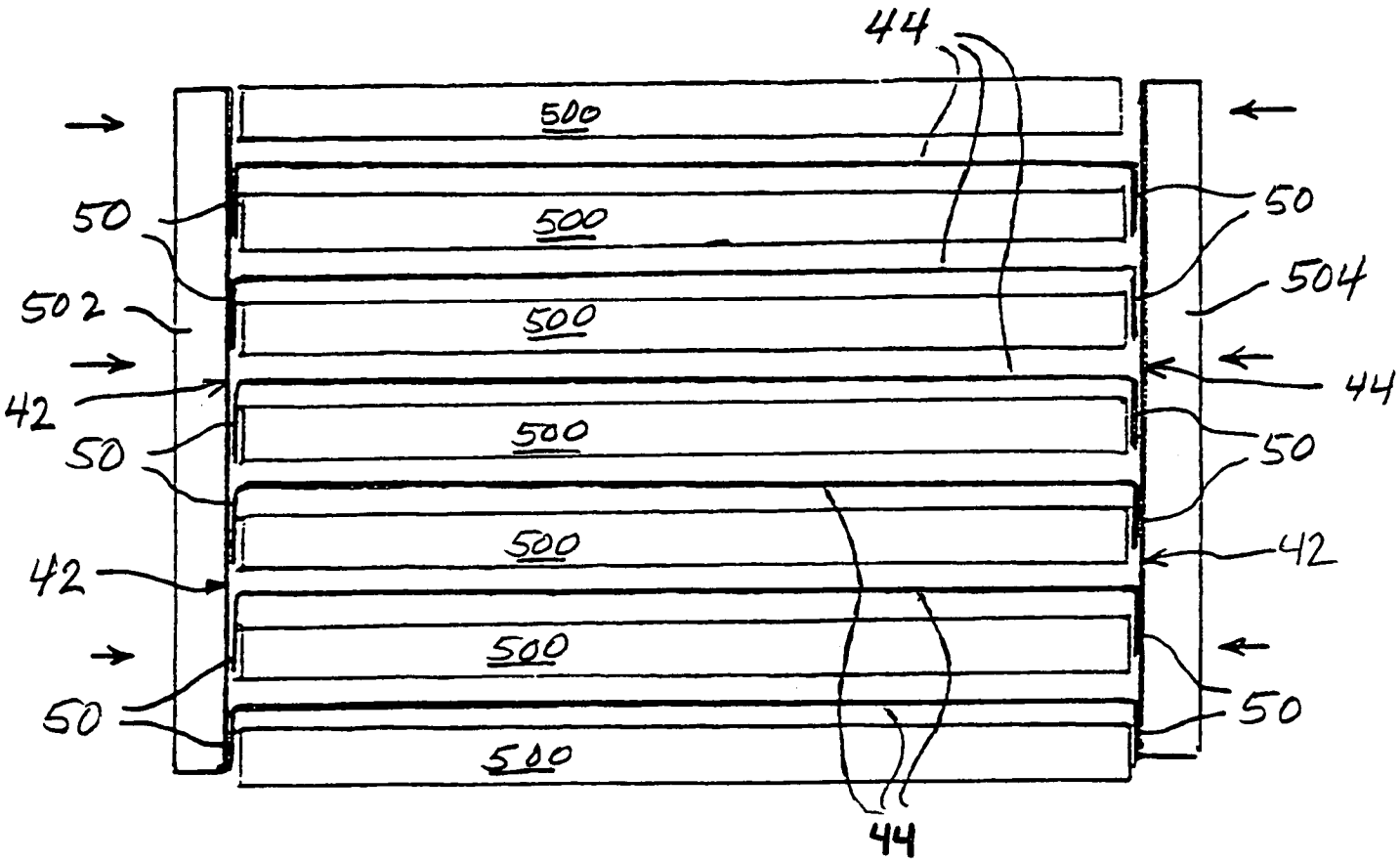
FIG. 14 is a top plan diagrammatic view illustrating a second step in the attachment of the dividers of FIGS. 4–11 in the file case of FIGS. 1–3.

Pressure is then exerted from both sides against the ends of the spacer slabs 500 by means of the laterally spaced bearing blocks 502. This force bends the side edge margins 50 further so that they are parallel to and in contact with the filing case side panel sheets 42 and 44 prior to the creation of accordion folds in the side panel sheets 42 and 44, as shown in FIG. 14. Heat or sonic energy is applied to the side edge marginal strips 50 at the locations at which they contact the ends of the spacer blocks 500 or at the corresponding locations of the pressure blocks 502 and 504, thereby compressing the side edge marginal strips 50 against the side panels 42 and 44, which are still in a flattened condition. Heat is concentrated along these regions simultaneously to both of the side panel sheets 42 and 44 and to all of the side edge marginal strips 50 of all of the divider partitions 44, all at the same time, as shown in FIG. 14.

Figure 15:
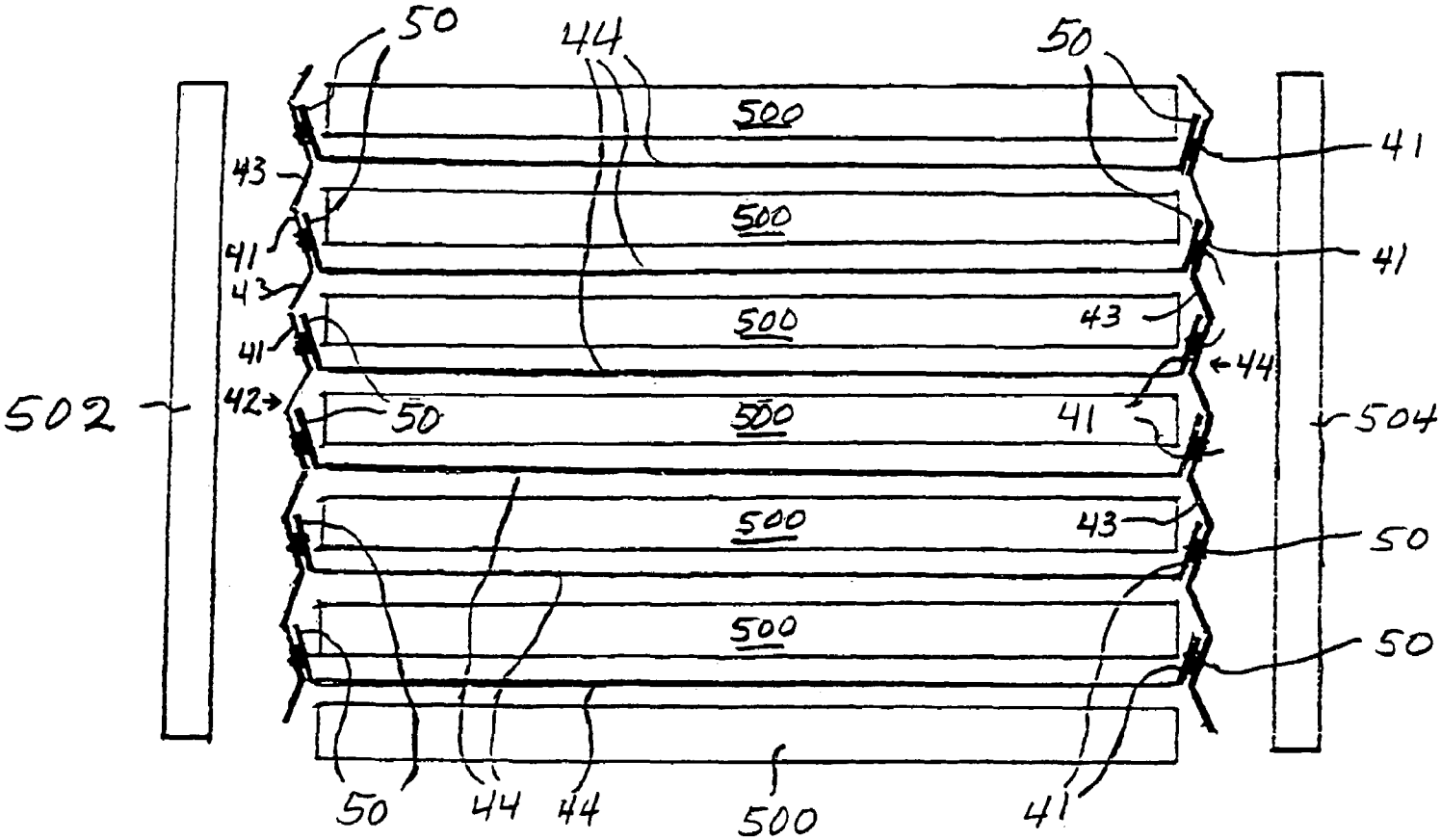
FIG. 15 is a top plan diagrammatic view illustrating a third step in the attachment of the dividers of FIGS. 4–11 in the file case of FIGS. 1–3.

The pressure blocks 502 and 504 are then retracted, leaving the side edge marginal strips 50 of all of the filing case divider partitions 44 heat sealed or sonic welded to the faces 41 of the filing case side panel sheets 42 and 44 at spaced intervals therebetween. The side panel sheets 42 and 44 are thereby simultaneously attached to all the thin, narrow, elongated attachment side margin strips 50, as illustrated in FIG. 15.

When the pressure blocks 502 and 504 are drawn apart, the natural resiliency of the file section divider partitions 44, and the plastic "memory" thereof, causes the side edge marginal strips 50 to depart somewhat from the perpendicular orientation relative to the main, central regions of the file section dividers 48, 49, 51, 53, 55, 57, and 59 at which they are oriented during the heat sealing or sonic welding process shown in FIG. 14. Instead, the side edge marginal strips 50 assume an obtuse angle relative to the central regions of the partitions 44 from which they extend, as illustrated in FIG. 15.

Figure 16:
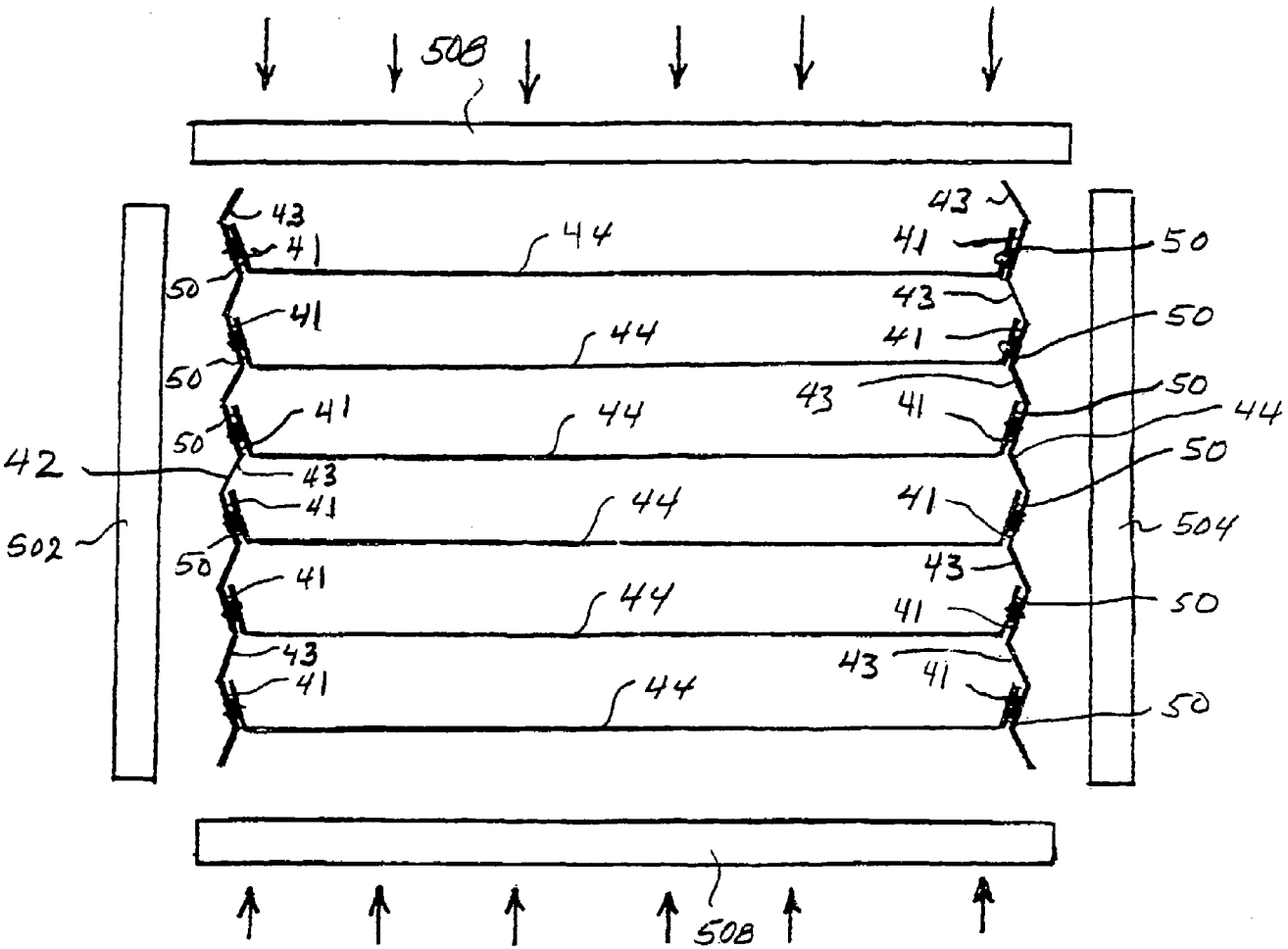
FIG. 16 is a top plan diagrammatic view illustrating a fourth step in the attachment of the dividers of FIGS. 4–11 in the file case of FIGS. 1–3.

The side edge marginal strips 50, in effect, hold the facing surfaces 41 and 43 of the filing case side panel sheets 42 and 44 in a zig-zag or wavy configuration, as illustrated in FIG. 16. This permits longitudinal accordion folds or pleats to be concurrently formed into the side panel sheets 42 and 44. This is accomplished by removing the spacer blocks 500 and by applying pressure in a direction perpendicular to the orientation of the main, central regions of the file section divider partitions 44 by means of pressure blocks 508, as illustrated in FIG. 16. The resulting structure of the attachment of the side edge marginal strips 50 to the surfaces 43 of the filing case side panels 42 and 44 in the manner depicted in FIG. 12 is thereby completed.

Undoubtedly numerous variations and modifications of the invention will become readily apparent to those familiar with the construction of file section dividers and expandable filing cases. For example, file section dividers may be produced with many different pocket sizes, shapes, and arrangement in addition to those shown in FIGS. 4 through 11. Accordingly, the scope of the invention should not be construed as limited to the specific embodiments depicted and described, but rather is defined in the claims appended hereto.

I claim:

1. In a file section divider formed as an expansive partition and having a laterally extending upper edge from which a file section label tab projects upwardly, an opposing laterally extending lower edge parallel to said upper edge, and mutually parallel opposing side edges oriented perpendicular to said upper and lower edges, the improvement comprising: a pocket panel secured to said expansive partition wherein said expansive partition and said pocket panel are formed from a common sheet of flexible material folded at a bottom edge fold which defines said lower edge of said partition and said pocket panel has a top opening edge located beneath said upper edge of said partition and mutually parallel pocket panel side edges that are parallel to said side edges of said partition and spaced closer together than said side edges of said partition so that said expansive partition is wider than said pocket panel, and said expansive partition has marginal file attachment strips located outboard from said pocket panel side edges and further characterized in that said pocket panel is secured directly to said expansive partition along at least one linear pocket delineation seal that is parallel to said pocket panel side edges and which forms an upper termination and wherein said pocket panel side edges are sealed directly to said expansive partition inboard from said side edges of said expansive partition by linear pocket side seals parallel to said pocket panel side edges and located inboard from said marginal file attachment strips.

2. A file section divider according to claim 1 wherein said upper termination of said linear pocket delineation seal is beneath said top opening edge of said pocket panel, and said pocket panel is split from said upper termination to said top opening panel edge, thereby defining separately manipulatable pocket apron flaps above and on both sides of said linear pocket delineation seal.

3. A file section divider according to claim 2 wherein said pocket side seals terminate at said apron flaps beneath said top panel edge.

4. A file section divider according to claim 3 wherein laterally directed notches are formed in said pocket panels at said apron flaps in an inboard direction from each of said pocket panel side seals and in both lateral directions from each pocket delineation seal.

5. A file section divider according to claim 1 wherein said at least one pocket delineation seal divides said pocket panel to produce a plurality of pockets of equal width.

6. A file section divider according to claim 1 wherein said at least one pocket delineation seal divides said pocket panel to produce a plurality of pockets of unequal width.

7. A file section divider according to claim 1 further characterized in that said top opening edge is notched inboard from each of said pocket panel side edges and on both sides of said upper termination of each linear pocket delineation seal.

8. A portable document storage device comprising:

a case including front and back covers, and a plurality of flexible file section dividers having mutually parallel, upper and lower divider edges and opposing, mutually parallel divider side edges oriented perpendicular to said upper and lower divider edges and said file section dividers are joined at said divider side edges to delineate said case into a plurality of filing compartments, and at least some of said file sections dividers are provided with a plurality of upwardly opening pockets, each formed from an extension panel projecting from a separate one of said dividers at said lower edge thereof and folded back against said divider from which it projects and terminating at an opposite top opening edge and wherein each extension panel has a pair of pocket panel side edges parallel to said side edges of said dividers and at least one of said extension panels is permanently fastened directly to said separate one of said dividers from which it projects along at least one linear pocket delineation seal parallel to and located between said pocket panel side edges and ending at a pocket delineation seal termination located beneath said divider upper edges.

9. A portable document storage device according to claim 8 wherein each pocket delineation seal termination is located a spaced distance from said top opening edge of said at least one extension panel which is split between said top opening edge thereof and said pocket delineation seal termination to define separately manipulatable pocket apron flaps above and on opposing sides of said pocket delineation seal termination.

10. A portable document storage device according to claim 8 wherein said pocket panel side edges are secured to said dividers inboard from said divider side edges by linear side pocket seals parallel to said pocket panel side edges and said pocket panels form pockets and pocket apron flaps above said pockets at locations beneath said upper divider edges and said pockets are closed at all their sides and are accessible by deflecting said pocket apron flaps away from said file section dividers.

11. A portable document storage device according to claim 10 wherein said pocket apron flaps are notched laterally adjacent all of said pocket delineation seals and at said pouch panel side edges.

12. A portable document storage device according to claim 10 wherein said pocket apron flaps project upwardly from a corresponding one of said pockets and each of said pocket apron panels is narrower in width than said corresponding pocket from which it projects.

13. A portable document storage device according to claim 10 wherein each of said pocket delineation seals defines pockets of unequal width on separate ones of said file section dividers.

14. A portable document storage device according to claim 10 wherein said pocket delineation seal is located closer to one of said pouch panel side edges than to the other.

15. A portable document storage device according to claim 10 further comprising a plurality of said linear pocket delineation seals on said at least one of said pouch extension panels.

16. A portable document storage device according to claim 8 wherein said case is formed with a pair of accordion folding side panels extending between said front and back covers, and said side panels form pleats each having first and second mutually facing surfaces, and said side edges of each of said section dividers are permanently secured to said side panels at said first surfaces of said separate pleats formed in said accordion folding side panels.

17. An expandable filing case having:

a plastic front cover and a plastic back cover, both having a top and a bottom, and plastic side panels extending between said front and back covers, each side panel having a plurality of accordion folded pleats formed therein, each pleat being formed with a pair of facing surfaces that are collapsible toward each other, a plurality of plastic file section dividers having opposing mutually parallel, upper and lower divider edges and opposing mutually parallel outboard divider side edges oriented perpendicular to said upper and lower divider edges, and each of said section dividers has side edge margins extending between said upper and lower divider edges and located immediately adjacent to said divider side edges, and each of said side edge margins is sealed to a single one of said facing surfaces in said pair of facing surfaces formed by said pleats to create folded pleated connections, whereby said section dividers are coupled to said front and back covers by said side panels, and at least one of said file section dividers is provided with a pocket panel extending from said lower edge thereof and said pocket panel is folded upwardly from said lower divider edge of said at least one file section divider to terminate at an upper panel edge located beneath said upper divider edge of said at least one file section divider, and said pocket panel has an upper pocket panel edge and pocket panel side edges parallel to and inboard from said divider side edges of said at least one of said file section dividers and said pocket panel is sealed directly to said at least one file section divider by at least one linear pocket delineation seal located between and extending parallel to said pocket panel side edges, and said linear pocket delineation seal has an upper terminus located below said upper pocket panel edge and defines filing pockets between said pocket delineation seal and said divider side edges of said at least one file section divider, and each of said filing pockets has an upwardly opening mouth located no higher than said upper divider edge of said at least one file section divider.

18. A portable document storage device according to claim 17 wherein each of said file section dividers is formed with a pair of marginal attachment strips at its side edges, and said marginal attachment strips are welded to said side panels at said pleats therein.

19. An expandable filing case according to claim 17 wherein at least some of said pocket panels are split downwardly from their upper pocket panel edges to create independently deflectable pocket tabs on both sides of said linear pocket delineation seal.

20. An expandable filing case according to claim 17 wherein said upper panel edge is arcuately curved concave upwardly on both sides of each pocket delineation seal, and notches are defined in each upper pocket panel edge on both sides of each pocket delineation seal.

21. An expandable filing case according to claim 17 wherein said upper panel edge is arcuately curved concave downwardly on both sides of each pocket delineation seal, and notches are defined in each upper panel edge on both sides of each pocket delineation seal.

22. An expandable filing case according to claim 17 wherein said pocket panel is split downwardly from said upper pocket panel edge to create independently deflectable pocket tabs on both sides of said linear pocket delineation seal whereby said linear pocket delineation seal creates a plurality of separate, laterally adjacent pockets.

* * * * *